US007863233B2

(12) United States Patent
Thonhauser

(10) Patent No.: US 7,863,233 B2
(45) Date of Patent: Jan. 4, 2011

(54) CLEANING AND DISINFECTING AGENT

(75) Inventor: Manfred Thonhauser, Perchtoldsdorf (AT)

(73) Assignee: Dipl. Ing. Thonhauser GmbH, Perchtoldsdorf (AT)

( * ) Notice: Subject to any disclaimer, the term of this patent is extended or adjusted under 35 U.S.C. 154(b) by 866 days.

(21) Appl. No.: 11/627,660

(22) Filed: Jan. 26, 2007

(65) Prior Publication Data

US 2007/0207941 A1 Sep. 6, 2007

Related U.S. Application Data

(63) Continuation-in-part of application No. 10/398,348, filed as application No. PCT/AT01/00258 on Jul. 26, 2001, now Pat. No. 7,737,101.

(30) Foreign Application Priority Data

Oct. 13, 2000 (AT) ..... A 1757/2000

(51) Int. Cl.
*C11D 17/00* (2006.01)

(52) U.S. Cl. ..... 510/218; 510/311; 510/379; 510/392

(58) Field of Classification Search ..... None
See application file for complete search history.

(56) References Cited

U.S. PATENT DOCUMENTS

| | | | | |
|---|---|---|---|---|
| 3,677,953 | A | 7/1972 | Harris | |
| 4,683,072 | A | 7/1987 | Holdt et al. | |
| 6,140,299 | A | 10/2000 | Eriksson | |
| 6,306,641 | B1 | 10/2001 | Horn et al. | |
| 6,455,086 | B1 | 9/2002 | Trinh et al. | |
| 6,534,075 | B1 * | 3/2003 | Hei et al. | 424/405 |

FOREIGN PATENT DOCUMENTS

| | | |
|---|---|---|
| GB | 1 510 452 | 5/1978 |
| WO | WO 98 42812 | 10/1998 |

* cited by examiner

*Primary Examiner*—Necholus Ogden, Jr.
(74) *Attorney, Agent, or Firm*—Pillsbury Winthrop Shaw Pittman LLP

(57) ABSTRACT

A detergent and disinfectant in which water-soluble permanganates are used in an alkaline solution in order to initiate the oxidation of organic substances and simultaneously a chemical oxidant, preferably a peroxodisulfate, is used which is capable of producing radical reactions with catalytic support by manganates originating from the supplied permanganate, which reactions produce the oxidation of organic substances. All components are present in powder form and a respective powder mixture can be dissolved rapidly and free from residues in water. It thus represents a universally applicable, highly effective detergent and disinfectant.

37 Claims, 1 Drawing Sheet

Fig. 1: Relative Stability (50% / 50%)
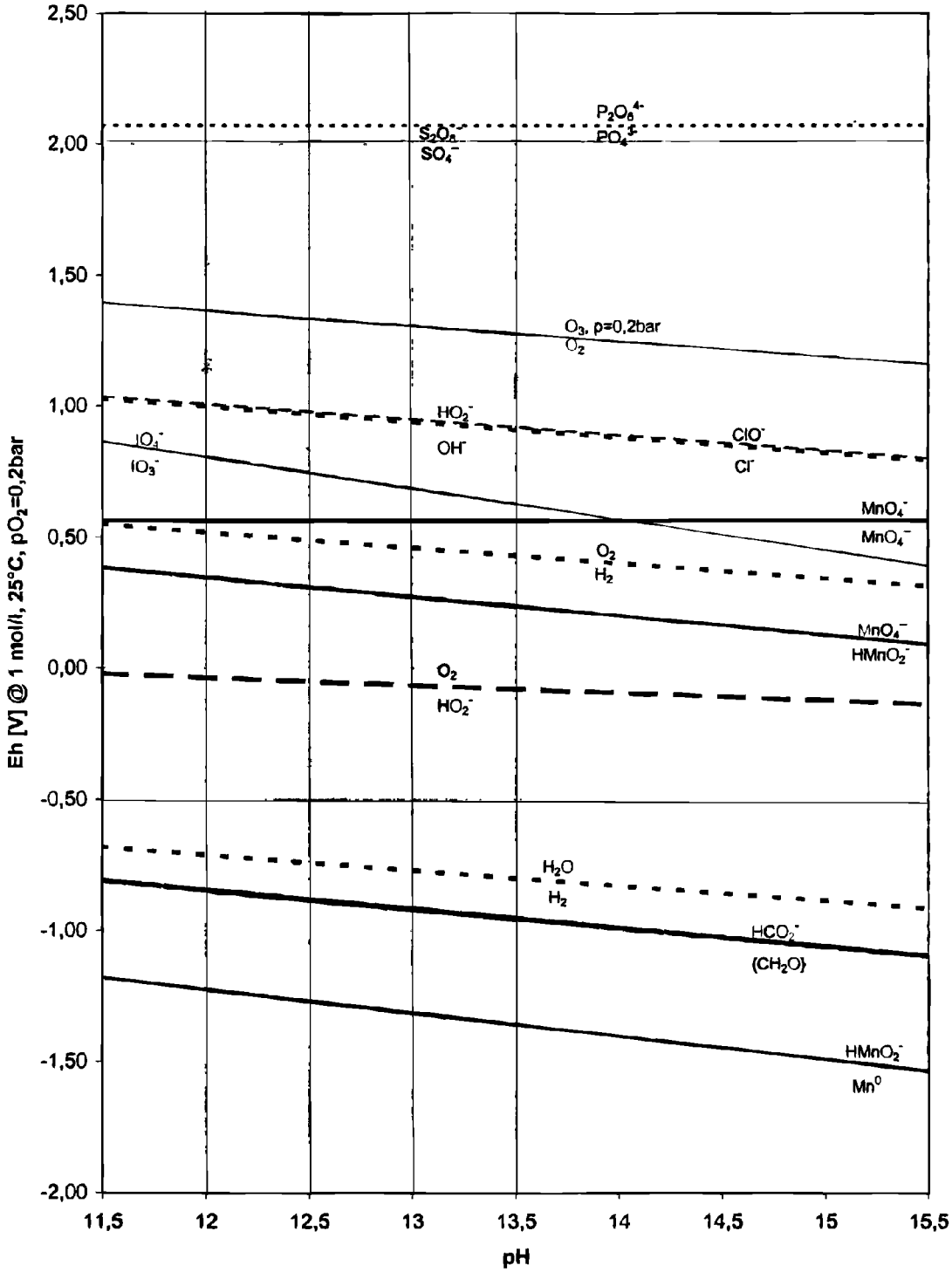

CLEANING AND DISINFECTING AGENT

CROSS REFERENCE TO RELATED APPLICATIONS

This application is a continuation in part application and hereby claims priority from U.S. patent application Ser. No. 10/398,348 filed on Apr. 4, 2003 now pending, the disclosure of which is hereby incorporated herein by reference in its entirety. The '348 application is a §371 application and claims priority from International Application PCT/AT01/00258 filed on Jul. 26, 2001, wherein that international application claims priority from Austrian Patent No. AT1757/2000 filed on Oct. 13, 2000, wherein the disclosures of the international application and the Austrian patent application are hereby incorporated herein by reference in their entirety.

BACKGROUND OF THE INVENTION

Chlorine is currently used especially for cleaning and disinfection. Compounds of chlorine such as hypochlorous acid (HOCl) or hydrochloric acid (HCl) are formed in a hydrous solution, on which in the end, together with the produced oxygen, the strongly oxidizing and therefore disinfecting effect of hydrous chlorine solutions is based. A similarly disinfecting effect is produced by the chloramines which arise during the reaction of chlorine with nitrogenous compounds, but which are felt by a number of people as being odorous and irritating to the eye. Critical side products of the disinfection with chlorine are finally chlorinated hydrocarbons. They occur in the reaction of chlorine with organic material and can be hazardous in higher concentrations. Efforts have therefore been undertaken regularly to replace chlorine by other chemicals for cleaning and disinfection without achieving the germicidal speed of chlorine.

A further problem in the use of chlorine for cleaning and disinfection is transport and storage, because special care must be observed in respective of this highly reactive substance.

Non-chlorine based detergents have been used in the past. For example, Great Britain patent GB 1 510 452 A discloses a detergent for toilet basins which consists of potassium permanganate and a sodium alkyl sulfate for reducing the surface tension. No further oxidants, especially in co-operation with potassium permanganate, are provided. The suitability of the agent must be doubted in general because no measures are undertaken in order to ensure the alkaline environment. Alkaline conditions, however, are necessary for preventing the precipitation of the manganese dioxide (Mn IV "brownstone") which shows a low water-solubility. Moreover, these alkaline conditions promote the germicidal effect of the potassium permanganate.

SUMMARY

One benefit of this invention is to provide a detergent and disinfectant which avoids such disadvantages while maintaining a similar oxidizing and disinfecting effect.

This is achieved by providing a detergent and disinfectant comprising: water-soluble permanganate, which is provided for initiating the oxidation of organic substances, an agent for securing an alkaline environment with a pH value of at least 10, and at least one further oxidant whose oxidation potential lies over that of manganese VII to manganese VI.

The water soluble permanganate can be in the form of potassium permanganate. Potassium permanganate ($KMnO_4$) is a strong oxidant whose germicidal effect has been known for a long time. In the strongly alkaline environment, it is based in particular on the reduction of the heptavalent manganese to the oxidation number +6. For different reasons, however, the use in detergents and disinfectants was never achieved. Due to its strong oxidation effect, potassium permanganate proved to be incompatible with other necessary ingredients of a detergent for example. Furthermore, water acts as a reductive in the face of the high oxidation potential of potassium permanganate, thus leading to stability problems of the detergents in a hydrous solution.

BRIEF DESCRIPTION OF THE DRAWING

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views:

FIG. 1 is a Pourbaix diagram for showing the reactions which are relevant for the efficiency of the detergent and disinfectant according to the invention.

DETAILED DESCRIPTION

At least one embodiment of the invention relates to a detergent or disinfectant which includes water-soluble permanganate, which is provided for initiating the oxidation of organic substances, an agent for securing an alkaline environment with a pH value of at least 10, and at least one further oxidant whose oxidation potential lies over that of manganese VII to manganese VI. The above detergent or disinfectant can be formed in multiple different or varying further embodiments.

For example, in at least one embodiment, an oxidant is added to the permanganate whose oxidation potential exceeds that of the permanganate. In accordance with at least one embodiment, this is achieved by adding peroxodisulfates, preferably sodium peroxodisulfate. As will be explained below in closer detail, radical reactions are initiated by their co-operation, as a result of which there is an efficient oxidation of organic substances.

At least one embodiment relates to a detergent and disinfectant which includes peroxodisulfates, preferably sodium peroxodisulfate, which are used as a further oxidant.

At least one embodiment relates to a detergent and disinfectant, wherein potassium permanganate is used as permanganate.

At least one embodiment relates to a detergent and disinfectant, wherein alkali hydroxides are used for achieving the alkaline environment. This induces an increase in the germicidal speed of the permanganate because the oxidation of organic compounds is accelerated under alkaline conditions.

At least one embodiment relates to a detergent and disinfectant, wherein oxidation-resistant polyphosphates are used as hardness stabilizers. This ensures that the applied hardness stabilizers (complexing agents) are resistant to the peroxodisulfates. Moreover, a certain protective effect against the corrosion of non-ferrous metals and plastics can be assumed.

At least one embodiment relates to a detergent and disinfectant, wherein all components are present in powder form.

At least one embodiment relates to a detergent and disinfectant, wherein 7 to 8 grams of the detergent and disinfectant are dissolved per liter of solution of detergent or disinfectant.

At least one embodiment relates to a detergent and disinfectant, wherein it is used in the following composition:

20%-35% of 50% KOH,

5%-25% of 50% potassium tripolyphosphate,

25%-35% of hypochlorite lye, at least 0.01% $KMnO_4$

At least one embodiment relates to a detergent and disinfectant, wherein it is used in a 3% hydrous solution.

At least one embodiment relates to a detergent and disinfectant comprising: water-soluble permanganate, which is provided for initiating the oxidation of organic substances, an agent for securing an alkaline environment with a pH value of at least 10, and at least one further oxidant whose oxidation potential exceeds 1.5 volts at said minimum pH of 10.

At least one embodiment relates to a detergent and disinfectant, wherein it is used in the following composition:

58% NaOH,

27% potassium tripolyphosphate,

15% $Na_2S_2O_8$, at least 0.01% $KMnO_4$

At least one embodiment relates to a detergent and disinfectant, wherein it is used in the following composition:

28% of 50% KOH,

15% of 50% potassium tripolyphosphate,

30% of hypochlorite lye, at least 0.01% $KMnO_4$

At least one embodiment further comprises a detergent and disinfectant, wherein said agent comprises an agent for securing an alkaline environment with a pH value of at least 12.

At least one embodiment relates to a detergent and disinfectant composition comprising:

50%-75% NaOH,

15%-35% of 54% potassium tripolyphosphate,

1%-20% $Na_2S_2O$, and 0.01%-0.5% $KMnO_4$

At least one embodiment relates to a detergent and disinfectant comprising:

water-soluble permanganate, which is provided for initiating the oxidation of organic substances;

an agent for securing an alkaline environment with a pH value of at least 10;

at least one further oxidant in the form of a peroxodisulfate whose oxidation potential lies over that of manganese VII to manganese VI.

At least one embodiment relates to a detergent and disinfectant, wherein the at least one further oxidant has an oxidation potential that lies over that of $HO_2^-$ to $OH^-$.

At least one embodiment relates to a detergent and disinfectant, wherein the alkali hydroxides comprise NaOH.

At least one embodiment relates to a detergent and disinfectant, wherein the oxidation-resistant polyphosphates which are used as hardness stabilizers include potassium tripolyphosphate.

At least one embodiment relates to a detergent and disinfectant comprising:

a) a cleaning agent in the form of a water-soluble permanganate for initiating the oxidation of organic substances;

b) an alkali agent for providing an alkaline environment with a pH value of at least 10; and c) at least one further oxidant acting as an accelerant whose oxidation potential lies over that of manganese VII to manganese VI.

At least one embodiment relates to a method for treating a beverage distribution system comprising using detergent and disinfectant comprising:

water-soluble permanganate, which is provided for initiating the oxidation of organic substances;

an agent for securing an alkaline environment with a pH value of at least 10, and which is used in combination with at least one further oxidant whose oxidation potential lies over that of manganese VII to manganese VI.

At least one embodiment relates to a detergent and disinfectant composition comprising:

62.935% NaOH, 30.5% of 54% potassium tripolyphosphate, 6.4% $Na_2S_2O_8$, and 0.165% $KMnO_4$ The reactions which are relevant for the efficiency of the detergent and disinfectant according to at least one embodiment are now described in detail by reference to a Pourbaix diagram (FIG. 1; for 25° C., 1 bar of atmospheric pressure and an electrolyte activity of 1 mol/L).

At first, a strong oxidant is provided in the form and concentration in accordance with at least one embodiment, which can contain an alkali peroxodisulfate. Although the alkali peroxodisulfate is a strong oxidant, is reacts only slowly with organic compounds at room temperature and under the absence of respective catalysts. The efficient and complete oxidation of organic substances is rather initiated by the potassium permanganate. Organic carbon is oxidized into oxalate. For the purpose of accelerating the reaction kinetics between potassium permanganate and organic substances, an alkali hydroxide is added, preferably NaOH, in order to thus guarantee an alkaline environment.

In the application of at least one embodiment, the detergent and disinfectant which is present in powder form is dissolved at first quickly in water without any residues. As a result of the composition, notice is taken that the dissolution of the hardness stabilizer occurs rapidly enough in order to prevent the precipitation of alkaline-earth carbonates and hydroxides as a result of the rising alkalinity of the solution, which is particularly decisive in the case of high water hardness. During the dissolution of the powder in accordance with at least one embodiment in water, there is at first the oxidation of hydroxide ions, namely by the peroxodisulfate (eq. 1) on the one hand, and also by the permanganate (eq. 2) on the other hand, with heptavalent manganese being reduced to manganese with oxidation number +6. A release of oxygen also occurs.

$$3OH^- + S_2O_8^{2-} = HO_2^- + 2SO_4^{2-} + H_2O \quad \text{Eq. 1}$$

$$4OH^- + 4MnO_4^- = O_2\uparrow + 4MnO_4^{2-} + 2H_2O \quad \text{Eq. 2}$$

The hydrogen peroxide ion arising during the oxidation of hydroxide ions by the peroxodisulfate can produce a reoxidation of the Mn(VI) to Mn(VII) (eq. 3):

$$HO_2^- + 2MnO_4^{2-} + H_2O = 3OH^- + 2MnO_4^- \quad \text{Eq. 3}$$

When the decomposition rate of the peroxodisulfate cannot keep up with that of the permanganate (e.g. because the decomposition of the permanganate is promoted by a high concentration and/or favorable oxidizability of the organic substance), an increased formation of Mn(VI) will occur. The dominance of the hexavalent manganese species leads to a green coloration of the solution, which is in contrast to the initial purple coloration produced by manganese VII. The oxidation of organic compounds (designated here with "$CH_2O$", which stands generally for carbon of oxidation number 0 and in particular for carbohydrate) into oxalate by Mn VII and the thus concomitant decomposition of the permanganate occurs rapidly, because the high pH value acts in an anionizing manner on numerous organic materials, which facilitates the attack of anionic oxidants. The oxidation of organic substances by Mn VII also involves $MnO_4^{3-}$, where manganese is present with the oxidation number +5 (eq. 4), but is oxidized again into hexavalent manganese by permanganate (eq. 5).

$$2\{CH_2O\}+3MnO_4^-+2H_2O=C_2O_4^{2-}+3MnO_4^{3-}+8H^+ \quad \text{Eq. 4}$$

$$MnO_4^{3-}+MnO_4^-=2MnO_4^{2-} \quad \text{Eq. 5}$$

The attack of the permanganate on organic substances according to eq. 4 does not lead to the high efficiency of the powder. The rapid and efficient oxidation of organic substances is rather produced by the now starting radical reactions. The starting point is an $SO_4^-$ radical which arises from the peroxodisulfate. This radical can be produced at first by homolytic cleavage of the peroxodisulfate (eq. 6) or by its reaction with organic compounds (eq. 7):

$$S_2O_8^{2-}=2SO_4^- \quad \text{Eq. 6}$$

$$2S_2O_8^{2-}+2\{CH_2O\}+2H_2O=2SO_4^{2-}+2SO_4^-+\{C^{+1}\text{—}R\}+4H+ \quad \text{Eq. 7}$$

In equation 7, $\{C^{+1}\text{—}R\}$ designates a radical with carbon in the oxidation number +1, e.g. formally $\{H_2C_2O_3\}^{2-}$, in which there is a double bond between the carbon atoms. Compounds in bold print designate radicals or radical ions.

As is shown by examination results, the $SO_4^-$ seems to be produced primarily by the co-operation with existing manganese compounds. It may be assumed that manganese VI or manganese V compounds have a radical-forming effect on peroxodisulfate according to the reactions 8 and 9:

$$MnO_4^{2-}+C_2O_4^{2-}+2H_2O=MnO_4^{3-}+2CO_3^{2-}+4H^+ \quad \text{Eq. 8}$$

$$MnO_4^{3-}+S_2O_8^{2-}=MnO_4^{2-}+SO_4^{2-}+SO_4^- \quad \text{Eq. 9}$$

A cascade of radical reactions is initiated, of which only the most important will be mentioned below. Thus, the $SO_4^-$ radical produces the formation of OH radicals (eq. 10). This radical belongs, as is generally known, to the most reactive compounds and oxidizes organic substances (eq. 11). $SO_4^-$ radicals can subsequently be produced again (eq. 12):

$$SO_4^-+H_2O=HSO_4^-+OH. \quad \text{Eq. 10}$$

$$2OH.+2\{CH_2O\}+H_2O=2OH^-+\{C^{+1}\text{—}R\}+4H^+ \quad \text{Eq. 11}$$

$$\{C^{+1}\text{—}R\}+4S_2O_8^{2-}+H_2O=4SO_4^{2-}+4SO_4^-+C_2O_4^{2-}+4H^+ \quad \text{Eq. 12}$$

After its formation according to eq. 10, the hydroxide radical can also react with oxalate (eq. 13). The sulfate radical is produced again subsequently by the peroxodisulfate (eq. 14):

$$OH.+C_2O_4^{2-}=OH^-+C_2O_4^- \quad \text{Eq. 13}$$

$$C_2O_4^-+S_2O_8^{2-}+2H_2O=2CO_3^{2-}+SO_4^{2-}+SO_4^-+4H^+ \quad \text{Eq. 14}$$

Another reaction channel for the oxidation of organic compounds involves the sulfate radical itself. The sulfate radical oxidizes organic compounds (eq. 15) and can finally be re-supplied again by peroxodisulfate (eq. 16):

$$2SO_4^-+2\{CH_2O\}+H_2O=2SO_4^{2-}+\{C^{+1}\text{—}R\}+4H^+ \quad \text{Eq. 15}$$

$$\{C^{+1}\text{—}R\}+4S_2O_8^{2-}+H_2O=4SO_4^{2-}+4SO_4^-+C_2O_4^{2-}+4H^+ \quad \text{Eq. 16}$$

The sulfate radical can also react with oxalate (eq. 17), with the same being re-supplied again by means of a peroxodisulfate molecule (eq. 18):

$$SO_4^-+C_2O_4^{2-}=SO_4^{2-}+C_2O_4^- \quad \text{Eq. 17}$$

$$C_2O_4^-+S_2O_8^{2-}+2H_2O=2CO_3^{2-}+SO_4^{2-}+SO_4^-+4H^+ \quad \text{Eq. 18}$$

It can thus be seen that in the course of the progress of the reactions 10 to 18 an efficient oxidation of organic compounds occurs, which oxidation is efficient through initiation of the radicals and is initiated by manganese compounds of different oxidation number and is maintained by peroxodisulfate.

Recombination reactions between radicals finally bring the chain reactions 10 to 18 to a final stop (eq. 19 to 24):

$$SO_4^-+SO_4^-=S_2O_8^{2-} \quad \text{Eq. 19}$$

$$SO_4^-+OH.=HSO_5^- \text{ (unstable)} \quad \text{Eq. 20}$$

$$4SO_4^-+\{C^{+1}\text{—}R\}+H_2O=4SO_4^{2-}+C_2O_4^{2-}+4H^+ \quad \text{Eq. 21}$$

$$OH.+OH.=H_2O_2 \quad \text{Eq. 22}$$

$$4OH.+\{C^{+1}\text{—}R\}+H_2O=4OH^-+C_2O_4^{2-}+4H^+ \quad \text{Eq. 23:}$$

$$3\{C^{+1}\text{—}R\}+3H_2O=C_2O_4^{2-}+4\{CH_2O\}+4OH^- \text{ (disproportionation of e.g. } \{H_2C_2O_3\}^{2-}) \quad \text{Eq. 24}$$

Since manganate (VI) acts thermodynamically unstable in water, a dominance of manganese II (eq. 25) occurs subsequently:

$$MnO_4^{2-}+H_2O=O_2\uparrow+HMnO_2^-+OH^- \quad \text{Eq. 25}$$

A yellow coloration of the solution shows the presence of managese(II) which forms oxalate complexes and thus also the essential completion of the cleaning and disinfection process.

During the entire progress of the chain reactions 10 to 25 there is a release of oxygen and hydrogen peroxide (eq. 1, 2, 16 and 25), which additionally supports the cleaning and disinfection process.

It is not necessary to exclusively use peroxodisulfate compounds as additional strong oxidants. Other oxidants whose oxidation potential exceeds that of manganese VII to manganese VI (line $MnO_4^-/MnO_4^-$ in the Pourbaix diagram of FIG. 1), and preferably that of $HO_2^-$ to $OH^{--}$ (line $HO_2^-/OH^-$ in the Pourbaix diagram of FIG. 1), are potential candidates. Periodate would also be suitable with respect to the line $MnO_4^-/MnO_4^{--}$, which ensures a re-oxidation of manganate V or VI into permanganate within the scope of a slightly modified chemism. Although the use of peroxodiphosphate and ozone is theoretically possible, it can hardly be realized from a technical viewpoint. Peroxodiphosphate is currently not available in larger quantities and ozone decomposes rapidly due to its high reactivity, as a result of which it does not seem to be suitable for commercial detergents and disinfectants. Although hypochlorite would be sufficiently stable in a hydrous solution, it would be necessary to ensure the electrochemical dominance of the reduction-oxidation pair $ClO^-/Cl^-$ for the formation of $HO_2^-$ ions even in the case of storage over longer periods of time.

All components of the detergent and disinfectant can be present in powdery form, a fact which apart from the efficient and rapid oxidation of organic substances is extremely advantageous for storing and transporting the agent.

Experiments also showed that the amount of sodium peroxodisulfate can be lowered, if the remaining components are adjusted suitably. This is advantageous since it helps to replace amounts of the comparably expensive peroxodisulfates by cheaper compounds. In addition, the composition of the detergent and disinfectant can be optimized for different areas of application by varying the compounds within the following ranges:

50%-75% NaOH,

15%-35% of 54% potassium tripolyphosphate,

1%-20% $Na_2S_2O$, and 0.01%-0.5% $KMnO_4$

For use of hypochlorite lye, these ranges can be specified as follows:

20%-35% of 50% KOH,

5%-25% of 50% potassium tripolyphosphate,

25%-35% of hypochlorite lye, at least 0.01% $KMnO_4$

The following examples should document the versatility of the possibilities for use of the detergent and disinfectant and shall not be understood as being limiting in any way.

EXAMPLE 1

The detergent and disinfectant in accordance with at least one embodiment can be used especially appropriately for beverage dispensing systems. The respective powder mixture contains 58% NaOH (prilled), 27.10% potassium tripolyphosphate, 14.75% sodium peroxodisulfate and 0.15% potassium permanganate. The application occurs in a concentration of approx. 8 g of powdery product per liter, with the dissolution in water occurring rapidly and free from residues. The release of sulfate, hydroxide and other radicals as well as the alkalinity promote the cleaning and disinfection process. The color change from purple (dominance of the manganese (VII) species) to green (dominance of the manganese (VI) species) and finally to yellow (dominance of the manganese (II/IV)) allows a visual evaluation of the cleaning progress.

EXAMPLE 2

The detergent and disinfectant in accordance with at least one embodiment can also be used for cleaning bottles. Currently, soiled bottles are immersed in lye baths. These baths substantially contain NaOH and additives for reducing the surface tension and need to be heated to at least 70° C. in order to allow a cleaning process. With the detergent and disinfectant it is possible to also achieve the desired sterilization at room temperature, which reduces the required machinery and improves cost-effectiveness. The bottles are merely sprayed with a powder mixture which is dissolved in water or with the two components NaOH/potassium tripolyphosphate and peroxodisulfate/permanganate which are present in liquid form. Following an exposure time which can be optimized easily due to the change of color, the sterilized bottles are sprayed off with water.

EXAMPLE 3

Inorganic coatings in vegetable- or potato-processing plants or breweries are usually difficult to dissolve because they consist of a mixture of salts which cannot be dissolved very well either by mineral acids or in alkaline solutions. They concern potassium oxalates, magnesium ammonium phosphates or silicates. The detergent and disinfectant allows the near residue-free removal of such precipitations. A hydrous solution of approx. 10% is produced with the recipe of this embodiment and the surfaces to be cleaned are treated with the same. Following an exposure time of less than one hour the coatings can be rinsed off easily with water.

EXAMPLE 4

The detergent and disinfectant in accordance with one embodiment can also be used for cleaning purposes in industrial applications, in particular for cleaning piping, in the following composition: 62.935% NaOH, 30.5% potassium tripolyphosphate, 6.4% sodium peroxodisulfate and 0.165% potassium permanganate. Again, the release of sulfate, hydroxide and other radicals as well as the alkalinity promote the cleaning and disinfection process. In addition, the color change from purple (dominance of the manganese (VII) species) to green (dominance of the manganese (VI) species) and finally to yellow (dominance of the manganese (II/IV)) allows a visual evaluation of the cleaning progress.

Accordingly, while a few embodiments of the present invention have been shown and described, it is to be understood that many changes and modifications may be made thereunto without departing from the spirit and scope of the invention as defined in the appended claims.

The invention claimed is:

1. A method of cleaning a surface in a plant, comprising obtaining a composition comprising a first oxidant comprising a water-soluble permanganate, an alkaline agent, and a second oxidant whose oxidation potential exceeds that of a mixture containing 50 mol % manganese VII and 50 mol % manganese VI; said composition changes color upon contact during oxidation of an organic substance, wherein the second oxidant comprises a peroxodisulfate.

2. The method of claim 1, wherein the water-soluble permanganate comprises potassium permanganate.

3. The method of claim 1, wherein the alkaline agent comprises an alkali hydroxide.

4. The method of claim 1, further comprising an oxidation resistant polyphosphate.

5. The method of claim 1, wherein all components of the composition are present in powder form.

6. The method of claim 1, wherein 7 to 8 grams of the composition is dissolved per liter of the aqueous liquid.

7. A method of cleaning a surface in a plant, comprising obtaining a composition comprising a first oxidant comprising a water-soluble permanganate, an alkaline agent, and a second oxidant whose oxidation potential exceeds that of a mixture containing 50 mol % manganese VII and 50 mol % manganese VI; said composition changes color upon contact during oxidation of an organic substance, wherein the composition comprises:

20%-35% of 50% KOH,

5%-25% of 50% potassium tripolyphosphate,

25%-35% of hypochlorite lye, and at least 0.01% $KMnO_4$.

8. The method of claim 7, wherein the composition is used in form of a 3% aqueous solution.

9. The method of claim 1, wherein the composition comprises:

58% NaOH,

27% potassium tripolyphosphate,

15% $Na_2S_2O_8$, and at least 0.01% $KMnO_4$.

10. The method of claim 7, wherein the composition comprises:

28% of 50% KOH,

15% of 50% potassium tripolyphosphate,

30% of hypochlorite lye, and at least 0.01% $KMnO_4$.

11. The method of claim 1, wherein said alkaline agent is formulated to secure an alkaline environment with a pH value of at least 12.

12. The method of claim 1, wherein the plant comprises a food processing plant.

13. The method of claim 1, further comprising disinfecting of the plant.

14. The method of claim 1, wherein an oxidation potential of the at second oxidant exceeds that of a mixture containing 50 mol % $HO_2^-$ and 50 mol % $OH^-$.

15. The method of claim 3, wherein the alkali hydroxide comprise NaOH.

16. The method of claim 4, wherein the oxidation resistant polyphosphate comprises potassium tripolyphosphate.

17. The method of claim 1, wherein the second oxidant comprises a hypochlorite.

18. The method of claim 1, wherein the composition changes color on contact with the organic, wherein said color change allows a visual evaluation of an amount of the organicoxidized by the composition.

19. The method of claim 1, wherein the color change is from purple to a second color other than purple.

20. The method of claim 1, wherein the second color is green.

21. The method of claim 1, wherein the second color is yellow.

22. The method of claim 1, wherein the organic substance and the peroxodisulfate reacts with the organic substance.

23. The method of claim 1, wherein the water-soluble permanganate reacts with the organic substance.

24. The method of claim 1, wherein the organic substance, the peroxodisulfate, and both the water-soluble permanganate and the peroxodisulfate react with the organic substance.

25. The method of claim 2, wherein the alkaline agent has a composition configured to secure an alkaline environment with a pH value of at least 10.

26. The method of claim 1, wherein the obtained color change is visually evaluated.

27. The method of claim 2, further comprising adding the composition in a form of a powder to water.

28. The method of claim 27, wherein the powder dissolves in the water free from a residue.

29. The method of claim 1, wherein the method is configured to monitor a cleaning progress during a cleaning operation.

30. The method of claim 1, wherein the method comprises cleaning in a brewery.

31. The method of claim 1, wherein the method is configured to sterilize a container.

32. The method of claim 31, wherein the container is sterilized by spraying the container with the composition and spraying off the composition applied to the container with water.

33. The method of claim 1, wherein the composition has a pH value of at least 10 and the composition is in an aqueous form ready for use in said method of cleaning the surface in the plant.

34. The method of claim 33, wherein the composition is used in about a 3% hydrous solution.

35. The method of claim 1, wherein the composition has a pH value of at least 12 and the composition is in an aqueous form ready for use in said method of cleaning the surface in the plant.

36. The method of claim 35, wherein the composition is used in about a 3% hydrous solution.

37. The method of claim 1, wherein the composition further comprises peroxodiphosphate, hyphochlorite, oxone or combinations thereof.

* * * * *

UNITED STATES PATENT AND TRADEMARK OFFICE

CERTIFICATE OF CORRECTION

PATENT NO. : 7,863,233 B2
APPLICATION NO. : 11/627660
DATED : January 4, 2011
INVENTOR(S) : Manfred Thonhauser It is certified that error appears in the above-identified patent and that said Letters Patent is hereby corrected as shown below:

On Title Page, item (75) Inventor

Insert --Christian Thonhauser, Vienna Austria-- co-inventor

Signed and Sealed this
Twenty-fourth Day of July, 2012

David J. Kappos
*Director of the United States Patent and Trademark Office*